US008011971B2

(12) United States Patent
Yang et al.

(10) Patent No.: US 8,011,971 B2
(45) Date of Patent: Sep. 6, 2011

(54) ADJUSTABLE PLUG AND EARPHONE UTILIZING THE SAME

(75) Inventors: Xin Yang, Shenzhen (CN); Wei Wu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/752,126

(22) Filed: Apr. 1, 2010

(65) Prior Publication Data

US 2010/0330829 A1 Dec. 30, 2010

(30) Foreign Application Priority Data

Jun. 29, 2009 (CN) ..... 2009 1 0303808

(51) Int. Cl.
*H01R 24/04* (2006.01)

(52) U.S. Cl. ..... 439/669; 439/825

(58) Field of Classification Search ..... 439/825–827, 439/668–669

See application file for complete search history.

(56) References Cited

U.S. PATENT DOCUMENTS 2,851,669 A * 9/1958 Koch ..... 439/265
4,964,807 A * 10/1990 Draus ..... 439/169

* cited by examiner

*Primary Examiner* — Ross Gushi
(74) *Attorney, Agent, or Firm* — Altis Law Group, Inc.

(57) ABSTRACT

A plug assembly includes an insulation housing and an insertion pole fixed to the insulation housing. The insertion pole is made of elastic material and includes at least two insertion portions extended along an extension direction of the insertion pole.

11 Claims, 3 Drawing Sheets

ADJUSTABLE PLUG AND EARPHONE UTILIZING THE SAME

BACKGROUND

1. Technical Field

The present disclosure relates to an adjustable plug and an earphone utilizing the same.

2. Description of Related Art

Generally, there are two different earphone plug sizes, depending on the device that uses them, i.e., 3.5 mm and 2.5 mm. When users want to switch from listening to one device to another device, they may have to switch earphones as well.

Therefore, what is needed is an earphone to overcome the described shortcoming.

DETAILED DESCRIPTION

Figure 1:
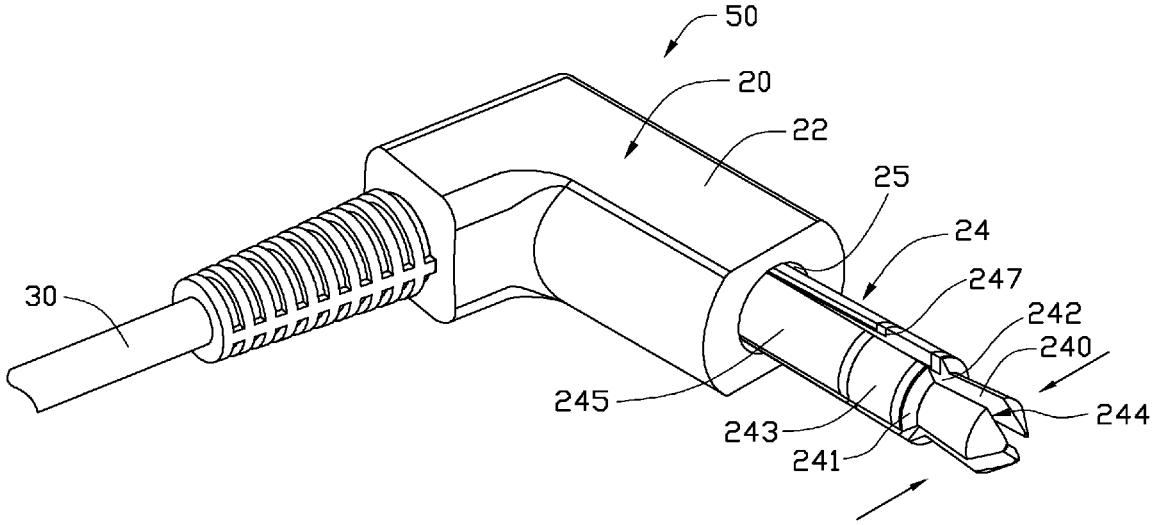
FIG. 1 is an isometric view of an earphone plug in an initial state in accordance with an exemplary embodiment.

Referring to FIG. 1, an earphone 50 is provided. The earphone 50 includes a plug assembly 20, two earbuds (not shown), and a wire 30 connecting the earbuds to the plug assembly 20. The plug assembly 20 is configured to electronically connect to an audio interface (not shown) of an audio device (not shown), so that, audio signals from the audio device are transmitted to the earbuds by the wire 30. In the exemplary embodiment, the audio device can be MP3, MP4, etc. The audio interface has one of at least two specifications, such as, 2.5 mm/3.5 mm.

The plug assembly 20 includes an insulation housing 22 and an insertion pole 24. One end of the insertion pole 24 is fixed to the insulation housing 22, and the other end of the insertion pole 24 extends through an opening 25 of the insulation housing 22 to extend out of the insulation housing 22, so as to insert into a corresponding audio interface. A plurality of grooves 244 are formed along an extension direction of the insertion pole 24, and extend to an axis of the pole 24, thereby dividing the insertion pole 24 into several insertion portions 240. In the exemplary embodiment, the insertion pole 24 is divided into three equal insertion portions 240. The insertion pole 24 is made of elastic material, and thus each of the insertion portions 240 is capable of being elastically deformed by an external force and rebounding to an initial state when the external force is removed. In the initial state, the insertion portions 240 are separated by the grooves 244. When the insertion portions 240 are received in an audio interface with a diameter less than the diameter of the insertion pole 24 in the initial state, then the insertion portions 240 are forced to move together, thus the diameter of the insertion pole 24 is reduced to fit the diameter of the audio interface. In the exemplary embodiment, the diameter of the insertion pole 24 exceeds 3.5 mm in the initial state. When the insertion portions 240 are received in an audio interface with a diameter equal to 3.5 mm, thus the diameter of the insertion pole 24 is reduced to equal to 3.5 mm. When the insertion portions 240 are received in an audio interface with a diameter equal to 2.5 mm, thus the diameter of the insertion pole 24 is reduced to equal to 2.5 mm.

Each of the insertion portions 240 includes an insulated body 242, a left channel contact portion 241, a right channel contact portion 243, and a grounding contact portion 245. The left channel contact portion 241, the right channel contact portion 243 and the grounding contact portion 245 are of equal width axially and encircle the insulated body 242, and are connected to the wire 30 by a conductor 247. The conductor 247 is embedded in the insulated body 242, thereby protecting the earphone 50 from damage.

Figure 2:
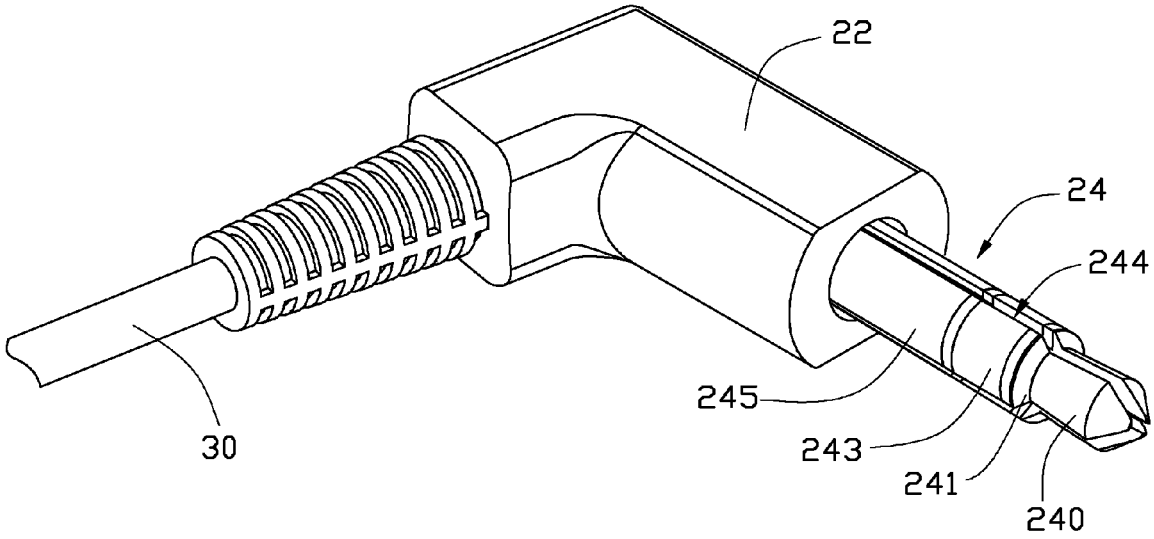
FIG. 2 is an isometric view of the earphone plug of FIG. 1, in a first state.

Referring to FIG. 2, user inserts the earphone 50 into an audio interface whose diameter is 3.5 mm by the insertion portions 240, and after the insertion portions 240 are received in the audio interface, the insertion portions 240 are forced to move together, and the diameter of the insertion pole 24 of the earphone is reduced to equal to 3.5 mm.

Figure 3:
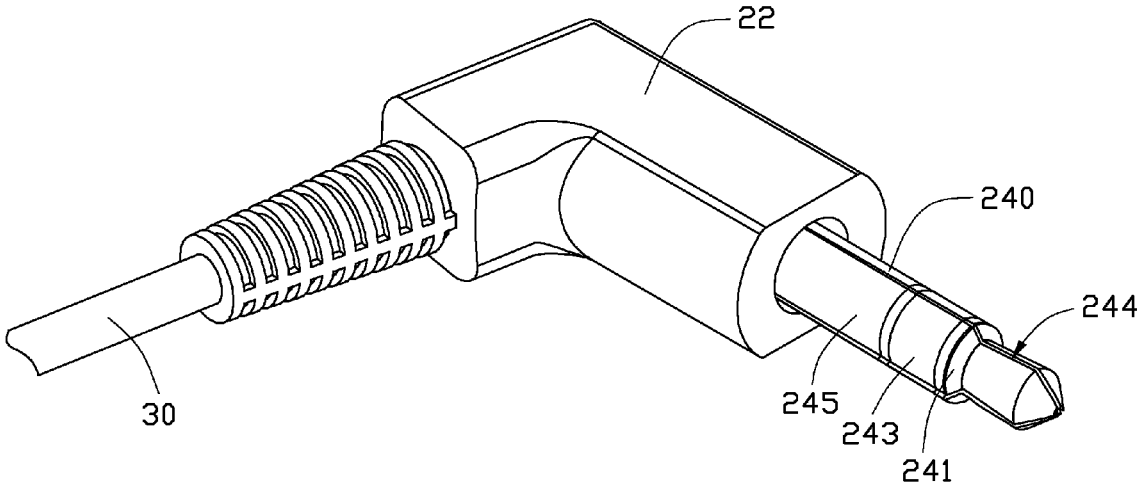
FIG. 3 is an isometric view of the earphone plug of FIG. 1, in a second state.

Referring to FIG. 3, user inserts the earphone 50 into an audio interface whose diameter is 2.5 mm by the insertion portions 240, and after the insertion portions 240 are received in the audio interface, the insertion portions 240 are forced to move together, and the diameter of the insertion pole 24 of the earphone is reduced to equal to 2.5 mm.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A plug assembly comprising:

an insulation housing; and an insertion pole fixed to the insulation housing and made of elastic material, and the insertion pole comprising at least two insertion portions extended along an extension direction of the insertion pole away from the insulation housing, each of the at least two insertion portions comprising an insulated body, a left channel contact portion, a right channel contact portion, and a grounding contact portion, wherein the insertion portions are separated; and wherein, when the insertion portions are received in a jack interface with a diameter less than the diameter of the insertion pole, the insertion portions are forced to move together, and the diameter of the insertion pole is reduced to fit the diameter of the jack interface.

2. The plug assembly as described in claim 1, wherein a plurality of grooves are formed along an extension direction of the insertion pole, and divide the insertion pole into the at least two insertion portions.

3. The plug assembly as described in claim 1, wherein one end of the insertion pole is fixed to the insulation housing and the other end of the insertion pole extends through an opening of the insulation housing to extend out of the insulation housing.

4. The plug assembly as described in claim 1, wherein the left channel contact portion, the right channel contact portion and the grounding contact portion are of equal width axially and encircle the insulated body, and are connected to a wire by a conductor.

5. The plug assembly as described in claim 4, wherein the conductor is embedded in the insulated body.

6. An earphone comprising a plug assembly configured for electronically connecting to an audio device, and the plug assembly comprising an insulation housing; and an insertion pole fixed to the insulation housing, and made of elastic material, and the insertion pole comprising at least two insertion portions extended along an extension direction of the insertion pole away from the insulation housing pole, each of the at least two insertion portions comprising an insulated body, a left channel contact portion, a right channel contact portion, and a grounding contact portion, wherein the insertion portions are separated; and wherein, when the insertion portions are received in a jack interface with a diameter less than the diameter of the insertion pole, the insertion portions are forced to move together, and the diameter of the insertion pole is reduced to fit the diameter of the jack interface.

7. The earphone as described in claim 6, wherein a plurality of grooves are formed along an extension direction of the insertion pole, and divide the insertion pole into the at least two insertion portions.

8. The earphone as described in claim 6, wherein the left channel contact portion, the right channel contact portion and the grounding contact portion are of equal width axially and encircle the insulated body, and are connected to a wire by a conductor.

9. The earphone as described in claim 8, wherein the conductor is embedded in the insulated body.

10. The earphone as described in claim 6, wherein the diameter of the plug assembly exceeds or equal to 3.5 mm in an initial state, and when the plug assembly is received in the jack interface, the diameter of the plug assembly is less than or equal to 2.5 mm.

11. The earphone as described in claim 6, wherein one end of the insertion pole is fixed to the insulation housing, and the other end of the insertion pole extends through an opening of the insulation housing to extend out of the insulation housing.

* * * * *